US011407631B2

(12) United States Patent
Christiansen

(10) Patent No.: US 11,407,631 B2
(45) Date of Patent: Aug. 9, 2022

(54) CLEANING UNIT FOR SUPPLYING A CLEANING LIQUID TO A BEVERAGE DISPENSING SYSTEM

(71) Applicant: CARLSBERG BREWERIES A/S, Copenhagen V (DK)

(72) Inventor: Jonas Christiansen, København V (DK)

(73) Assignee: Carlsberg Breweries A/S, Copenhagen (DK)

( * ) Notice: Subject to any disclaimer, the term of this patent is extended or adjusted under 35 U.S.C. 154(b) by 0 days.

(21) Appl. No.: 16/758,472

(22) PCT Filed: Oct. 26, 2018

(86) PCT No.: PCT/EP2018/079437
§ 371 (c)(1),
(2) Date: Apr. 23, 2020

(87) PCT Pub. No.: WO2019/081720
PCT Pub. Date: May 2, 2019

(65) Prior Publication Data

US 2020/0247657 A1 Aug. 6, 2020

(30) Foreign Application Priority Data

Oct. 27, 2017 (EP) ..... 17198816

(51) Int. Cl.
*B67D 1/07* (2006.01)
*B67D 1/08* (2006.01)
*B67D 1/00* (2006.01)

(52) U.S. Cl.
CPC ..... *B67D 1/07* (2013.01); *B67D 1/0837* (2013.01); *B67D 1/0882* (2013.01); *B67D 1/0888* (2013.01); *B67D 2001/0093* (2013.01)

(58) Field of Classification Search
CPC ..... B67D 1/07; B67D 1/0834; B67D 1/0837; B67D 1/0882; B67D 1/0888; B67D 2001/0093
See application file for complete search history.

(56) References Cited

U.S. PATENT DOCUMENTS 2,770,248 A * 11/1956 Audia ..... B67D 1/07 137/554
3,025,863 A * 3/1962 Eberle ..... B41F 31/08 134/102.1

(Continued)

FOREIGN PATENT DOCUMENTS

CA 2412480 A1 5/2004
CN 102563124 A 7/2012

(Continued)

*Primary Examiner* — Paul R Durand
*Assistant Examiner* — Randall A Gruby
(74) *Attorney, Agent, or Firm* — BakerHostetler

(57) ABSTRACT

A cleaning unit (38) for supplying a cleaning liquid to a beverage dispensing system, in which the cleaning unit (38) comprises a first inlet (36) for receiving a pressure fluid, a second inlet (44) for receiving a cleaning liquid, an outlet (42) for supplying the cleaning liquid to a discharge valve of the beverage dispensing system, and a drive mechanism for forcing the cleaning liquid from the second inlet (44) to said outlet (42) by using the pressure fluid received at the first inlet.

16 Claims, 2 Drawing Sheets

(56) References Cited

U.S. PATENT DOCUMENTS

| | | | | | |
|---|---|---|---|---|---|
| 4,276,914 | A * | 7/1981 | Albertson | B08B 9/0323 | 123/41.42 |
| 4,527,585 | A * | 7/1985 | Mirabile | B08B 9/0323 | 134/166 C |
| 4,597,416 | A * | 7/1986 | Scales | B60H 1/00585 | 134/169 A |
| 4,848,381 | A * | 7/1989 | Livingston | A23G 7/00 | 134/57 R |
| 4,877,043 | A * | 10/1989 | Carmichael | F02B 77/04 | 134/57 R |
| 4,911,832 | A * | 3/1990 | Miller | E03D 9/00 | 134/169 R |
| 5,090,440 | A * | 2/1992 | Ladouceur | B08B 9/0323 | 137/209 |
| 5,343,907 | A * | 9/1994 | Wagner | B67D 1/07 | 134/104.1 |
| 5,601,127 | A | 2/1997 | Hanson | | |
| 5,762,096 | A | 6/1998 | Mirabile | | |
| 7,857,910 | B2 * | 12/2010 | Carhuff | B08B 9/0327 | 134/22.18 |
| 8,905,266 | B2 * | 12/2014 | De Brabanter | G01F 11/00 | 222/77 |
| 10,315,236 | B2 * | 6/2019 | Bertness | B08B 9/0325 | |
| 10,752,486 | B2 * | 8/2020 | Chao | B67D 1/0867 | |
| 10,822,219 | B2 * | 11/2020 | Katz | B08B 3/04 | |
| 11,091,360 | B2 * | 8/2021 | Christiansen | B67D 1/0857 | |
| 2006/0175352 | A1 | 8/2006 | Emmendorfer et al. | | |
| 2007/0204884 | A1 | 9/2007 | Moore et al. | | |
| 2013/0104743 | A1 | 5/2013 | Deo et al. | | |
| 2014/0166053 | A1 | 6/2014 | Carson et al. | | |
| 2021/0261400 | A1 * | 8/2021 | Danielson | B67D 1/0855 | |

FOREIGN PATENT DOCUMENTS

| | | | |
|---|---|---|---|
| CN | 203599119 | U | 5/2014 |
| DE | 19602652 | A1 | 7/1997 |
| EP | 1025917 | A1 | 8/2000 |
| EP | 1720668 | A1 | 11/2006 |
| EP | 3067311 | A1 | 9/2016 |
| FR | 2638730 | A1 | 5/1990 |
| GB | 2297598 | A | 8/1996 |
| WO | 01/05526 | A1 | 1/2001 |
| WO | 2005/016814 | A1 | 2/2005 |
| WO | 2005/084832 | A1 | 9/2005 |
| WO | 2005/097364 | A1 | 10/2005 |
| WO | 2007/053665 | A2 | 5/2007 |
| WO | 2007/076584 | A2 | 7/2007 |
| WO | 2008/031622 | A1 | 3/2008 |
| WO | 2008/147199 | A2 | 12/2008 |
| WO | 2008/147200 | A2 | 12/2008 |
| WO | 2008/147201 | A2 | 12/2008 |
| WO | 2008/147202 | A2 | 12/2008 |
| WO | 2008/147203 | A1 | 12/2008 |
| WO | 2009/052827 | A1 | 4/2009 |
| WO | 2009/121332 | A2 | 10/2009 |
| WO | 2010/029122 | A1 | 3/2010 |
| WO | 2010/060946 | A1 | 6/2010 |
| WO | 2010/060949 | A1 | 6/2010 |
| WO | 2011/117192 | A1 | 9/2011 |
| WO | 2012/120254 | A1 | 9/2012 |
| WO | 2012/153824 | A1 | 11/2012 |
| WO | 2015/018965 | A1 | 2/2015 |
| WO | 2015/028523 | A1 | 3/2015 |
| WO | 2016/051204 | A2 | 4/2016 |
| WO | 2017/072114 | A1 | 5/2017 |

* cited by examiner

CLEANING UNIT FOR SUPPLYING A CLEANING LIQUID TO A BEVERAGE DISPENSING SYSTEM

CROSS-REFERENCE TO RELATED APPLICATIONS

This application is the National Stage of International Patent Application No. PCT/EP2018/079437 filed Oct. 26, 2018, which claims the benefit of European Patent Application No. 17198816.5 filed Oct. 27, 2017, the disclosure of which is incorporated herein by reference in its entirety for any and all purposes.

The present invention relates to a cleaning unit for supplying a cleaning liquid to a beverage dispensing system, a beverage dispensing system comprising a cleaning unit and a method of cleaning a beverage dispensing system.

INTRODUCTION

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic beverages such as soft drinks and non-carbonated beverages such as wine and fruit juice may be dispensed using a beverage dispensing system. Beverage dispensing systems are mostly for professional users such as in establishments like bars, restaurants and hotels, however, increasingly also for private users such as in private homes.

Professional beverage dispensing systems typically dispense beverage provided in large beverage kegs. Such beverage kegs may hold 20-50 litres of beverage for a professional beverage dispensing system for allowing typically 50-100 beverage dispensing operations before needing to exchange the beverage keg. Typically, beverage kegs are made of solid materials such as steel and re-filled a number of times. In between each filling, the beverage kegs are carefully cleaned. Insufficient cleaning may lead to unhygienic beverage kegs, which may in turn lead to health problems for the beverage consumer. Alternatively, beverage kegs are made collapsible for single use only due to the above hygiene concern.

An example of such a beverage dispensing system using collapsible beverage kegs is the DraughtMaster™ system provided by the applicant company. Such beverage dispensing systems using collapsible beverage containers in the form of beverage kegs typically have the beverage keg installed in a pressure chamber. When dispensing beverage from the beverage dispensing system, a pressure fluid is allowed to enter the beverage keg in case of using a metal keg which is not collapsible, or the pressure chamber in case of using a collapsible keg. When using a metal keg, the keg itself may be considered to be the pressure chamber and thus, the pressure chamber defines the beverage container. During the dispensing of beverage from the pressure chamber, the pressure fluid acts on the beverage and forces the beverage out of the pressure chamber. If a collapsible beverage keg is used, the beverage keg collapses while dispensing the beverage, and the volume of the beverage keg is reduced corresponding to the amount of dispensed beverage. The collapsible beverage kegs are preferably made of flexible and disposable material such as plastic.

While performing a dispensing operation, the force of the pressure causes the beverage to flow out of the beverage container and into a tapping line. The tapping line leads to a tapping device typically having a tapping valve and a tapping handle for allowing an operator to control the tapping valve and thereby the beverage dispensing operation. The operator, such as a bartender or barmaid, uses the tapping device to control the flow of beverage dispensing. After each beverage dispensing operation, residual beverage will inevitably be left in the tapping line and in the tapping device. After a certain amount of time, a layer of residual beverage may be formed inside the tapping line and tapping device. Such layers of residual beverage may solidify and eventually clog the tapping line and/or the tapping device, which will impair the beverage dispensing operation. However, well before clogging the tapping line and/or tapping device, the residual beverage will pose a hygienic problem. The tapping line and the tapping device constitute areas where bacterial growth may be accelerated due to the presence of beverage, the large surface area in comparison to the beverage volume, the lack of sufficient cooling and the close proximity to the outside. Bacterial growth due to lack of hygiene in the tapping line and the tapping device may constitute a quality problem for the beverage consumer. Additionally, crust formation of solidified beverage within the tapping line may occur. Therefore there is a need for technologies for cleaning the tapping line and the tapping device after a certain period of time or alternatively after a certain number of beverage dispensing operations.

For private users, the above problem may be solved by using a disposable tapping line and tapping device intended for single use only. For a professional user, a single use tapping line and tapping device would mean that the operator would have to reinstall the tapping line and tapping device regularly. Frequent installation would require considerably more time compared to having the tapping line and tapping device permanently installed in the establishment. Some establishments may have the pressure chamber in a different location, such as in the basement below the actual tapping location, which would require an even larger effort for changing the tapping line. In such establishments, the tapping device itself will typically be made of non-disposable materials for the reason of good appearance.

Cleaning units for beverage dispensing systems are well known in the art and below some of the existing prior art will be mentioned and briefly commented on.

WO 2008/147199 A2 discloses a control system for a beverage dispensing apparatus. The control system comprises operating means for switching between a first condition in which beverage can be dispensed from the holder via the tapping line and the rising line is separated from the tapping line and a second condition in which rinsing liquid and/or water can be introduced via the rinsing line into the tapping line and the holder is separated from the tapping line and the rinsing line.

WO 2008/147200 A2 discloses a tapping device. The tapping device comprises a connecting device which has a remotely operable regulating unit with which communication can be effected between a rinsing line and a beverage dispensing line.

WO 2008/147201 A2 discloses an apparatus for dispensing beverage. The apparatus comprises a line system and at least one draw-off tap. The line system comprises at least a rinsing line and a dispensing line and a valve device for connecting the dispensing line to, at will: a holder, for fluid communication between a holder and the tapping line, or the rising line for fluid communication between the rinsing line and the dispensing line.

WO 2008/147202 A2 discloses a beverage container, comprising a casing and an outer holder included therein. A three-way valve is connected to a beverage dispensing line and a supply line. The supply line may connect to a rinsing line for supply of rinsing means, such as water or another cleaning agent.

WO 2008/147203 A2 discloses a dispensing apparatus. In one embodiment, each container is connected by a three-way valve to the beverage dispensing line system so that each of the containers can be drawn empty or the rinsing line can be connected to the beverage dispensing line for cleaning the beverage storage and dispensing apparatus.

WO 2010/029122 A1 relates to a method of cleaning and flushing a beverage dispensing system. The method involves providing a first cartridge containing a cleaning fluid, positioning the first cartridge in the pressure chamber and dispensing the cleaning fluid from the dispensing valve. Further, the method involves providing a second cartridge containing a flushing fluid, positioning the second cartridge in the pressure chamber and dispensing the flushing fluid from the dispensing valve.

WO 2010/060946 A1 relates to a method of cleaning and flushing a beverage dispensing system comprising a sealable pressure chamber containing a beverage, a sealable multi-chambered cartridge located outside the pressure chamber comprising a first cartridge containing a cleaning fluid and a second cartridge containing a flushing fluid.

WO 2011/117192 A1 relates to a method of cleaning and flushing a beverage dispensing system comprising a sealable pressure chamber containing a beverage, a sealable multi-chambered cartridge located outside the pressure chamber comprising a first cartridge containing a cleaning fluid and a second cartridge containing a flushing fluid.

WO/2010/060949 A1 relates to a method of detecting the operational mode of a beverage dispensing system. The beverage dispensing system comprises a first detector having a pressure input and a control pressure output and a second detector having a pressure input and a control pressure output. The method comprises evaluating as a logical AND the control pressures from the control pressure outputs of the detectors and determining the operational mode of the beverage dispensing system.

Further prior art is mentioned and briefly commented on below:

CA 2412480 A1 relates to a cleaning "cartridge" for water dispensers.

DE 19602652 A1 relates to a four way valve for cleaning, flushing and beer.

FR 2638730 relates to a modular device, uses no pressurization unit but instead the water mains pressure.

GB 2297598 discloses a system for cleaning and flushing multiple dispensers.

WO 2007/053665 discloses a modular dispensing system which allows cleaning of the lines. It also includes a GUI (Graphical User Interface).

WO 2007/076584 relates to a beverage dispensing system using a cleaning cartridge.

WO 2009/121332 discloses a non-modular dispenser having a cleaning cartridge.

EP 1025917 A1 relates to a cleaning unit for draught beer systems using hot water or steam and being coupled to the beverage tap.

EP 1720668 B1 relates to a cleaning system for beverage dispensing systems which monitors the concentration of cleaning liquid in the lines.

EP 3067311 A1 relates to a beverage line cleaning system connected to water and sanitizing fluid and capable of cleaning with water or a mixture of water and sanitizing fluid.

U.S. Pat. No. 5,601,127 A relates to a cleaning system which circulates cleaning fluid from one tap through the connecting conduits to the other taps.

US 2007/0204884 A1 relates to a cleaning system using a pulsed flow of cleaning fluid for an additional cleaning effect.

US 2014/0166053 A1 relates to a cleaning system in which electric valves are used and in which remote cleaning is possible.

WO 01/05526 A1 relates to a cleaning system in which the cleaning fluid is allowed to remain static in the line for a period of time.

WO 2005/016814 A1 relates to a cleaning system where the cleaning liquid is drawn from an inlet near the tap to an outlet near the keg.

WO 2005/084832 A1 is a cleaning system in which the concentration of the cleaning liquid is monitored at the outlet.

WO 2005/097364 A1 is a cleaning system having a key switch such that it is operable only by authorized persons.

WO 2007/053665 A2 relates to a controller based management of a dispensing system. It also includes a cleaning process.

WO 2008/031622 A1 is a cleaning system in which the cleaning liquid enters one tap and exits through another tap.

WO 2012/120254 A1 is a cleaning system logging the amount of cleaning fluid passing through the inlet and submits the results through the internet.

WO 2012/153824 A1 is cleaning system using a flow of a gas/liquid multiphase (water and CO2) for cleaning.

WO 2015/018965 A1 is a beverage dispensing system having a cleaning module controlled by a program.

WO 2015/028523 A1 is cleaning system using pressure actuated valves.

WO 2016/051204 A2 is a cleaning system using a gas for purging the beverage line for cleaning, thereby using less liquid. The cleaning system may further comprise a pump for moving the liquid around the cleaning system.

US 2006/0175352 is a beverage dispensing system having a control system including a controller for managing the cleaning of the beverage dispensing system. The control system includes pumps, yet no inlet for receiving a pressure fluid. Further, this citation requires the separate use of a gas blender to mix pressurized gases (N2, CO2) to control the constant flow of mixed gas into steel beverage containers.

One problem noticed in connection with commercial cleaning systems and the above prior art is the lack of modularity, i.e. the user has to use the system which is compatible with the beverage dispensing system and has no opportunity to modify it according to the particular preferences of the user, e.g. operator.

Thus, it is the object of the present invention to provide cleaning units for supplying a cleaning liquid to a beverage dispensing system, whereby the cleaning units are modular, i.e. capable of being modified and operating according to the requirements of the user.

SUMMARY OF THE INVENTION

According to a first aspect of the present invention, these and other objects are achieved by a cleaning unit for supplying a cleaning liquid to a beverage dispensing system, said beverage dispensing system comprising one or more sealable pressure chambers, each defining a beverage container or containing a beverage container, said one or more pressure chambers being in fluid communication with one or more tapping devices via a beverage connector and a tapping line, said beverage connector allowing a beverage to be dispensed from said one or more tapping devices when said one or more pressure chambers are pressurized, said cleaning unit comprising:

a first inlet for receiving a pressure fluid, a second inlet for receiving a cleaning liquid, said cleaning liquid comprising water and an active cleaning agent, an outlet for supplying said cleaning liquid to said beverage connector of said beverage dispensing system and an outlet for supplying said pressure fluid, a guiding mechanism for steering the passage of said cleaning liquid from said second inlet to said outlet, by using said pressure fluid received at said first inlet, and a user interface for controlling said guiding mechanism and/or said beverage connector, and wherein said beverage connector is a discharge valve, said discharge valve having at least a beverage dispensing position, a cleaning position and a closed position, said beverage dispensing position allowing a beverage to be dispensed from said tapping device when said one or more pressure chambers are pressurized while preventing a cleaning liquid from being dispensed from said one or more tapping devices, said cleaning position allowing said cleaning liquid to be dispensed from said one or more tapping devices while preventing said beverage from being dispensed from said one or more tapping devices, and said closed position preventing any of said beverage and cleaning liquid being dispensed from said one or more tapping devices.

Suitably, said pressure fluid is a fluid passing through a pressure line and said cleaning liquid is a liquid passing through a cleaning line.

The control unit comprises an outlet for supplying said pressure fluid. Suitably, the control unit comprises a plurality of outlets for supplying said pressure fluid. The pressure fluid serves to pressurize the one or more pressure chambers. Hence, one or more pressure lines extend from the cleaning unit for pressurization of the one or more pressure chambers.

Suitably also, the control unit comprises a third inlet for receiving water, e.g. from water mains. It would be understood, that this third inlet is a separate inlet for receiving water.

Suitably also, the control unit comprises a fourth inlet for receiving electricity (power inlet) from electricity mains. It would also be understood, that this fourth inlet is a separate inlet for receiving electricity (power inlet) from electricity mains.

The invention enables that the tapping line and tapping device(s) are permanently installed, thereby the operator saves time in replacing such parts, which otherwise will be necessary to perform regularly.

The invention provides also higher flexibility due to its modularization, in the sense that the system may be adapted, customized, expanded and modified depending on the needs of the user. For instance, the cleaning unit via the user interface allows different modules to be connected, such as sources for water, active cleaning agent such as a detergent, as well as devices such as an air compressor or air pressure line. In some countries, an air compressor may need to be connected due to the lack of air pressure lines while in other countries, air pressure lines are readily available thus enabling its connection to the control unit e.g. via a reduction valve.

The cleaning unit is provided with an outlet for supplying the cleaning liquid. In one embodiment, the cleaning liquid is supplied to the beverage connector of said beverage system. However, by the invention it is also envisaged that the cleaning liquid suitably via a cleaning liquid line is manually attached to the beverage connector after e.g. removing the beverage container. This technique may be used e.g. for mobile cleaning units.

The beverage dispensing system may preferably constitute a professional system, which is preferably fixated in an establishment such as a bar or a restaurant or the like. The cleaning unit according to the first aspect of the present invention is preferably employed in connection with the exchange of the beverage container, e.g. beverage keg or in-between changing the beverage keg.

The tapping device may constitute a valve and a handle for selectively dispensing beverage into a glass or the like. The tapping device is additionally used for dispensing the cleaning liquid. The cleaning liquid cleans and rinses the tapping line and the beverage connector while passing through the beverage dispensing system. After leaving the dispensing device, the cleaning liquid may flow into a drain system, which is typically provided below the dispensing device for collecting beverage which has been excessively dispensed.

The tapping line may constitute a pipe of plastic or metal which is fixated to the establishment. The tapping line connects the discharge valve with the tapping device for transporting the beverage cleaning liquid and flushing fluid from the discharge valve to the tapping device.

The beverage connector further comprises a cleaning position allowing said cleaning liquid to be dispensed from said one or more tapping devices while preventing said beverage from being dispensed from said one or more tapping devices.

The beverage connector is a discharge valve. The beverage connector is preferably located in close connection with the pressure chamber or is alternatively part of the pressure chamber. The beverage connector constitutes a three-port valve connected to the tapping line, the pressure chamber and the cleaning unit. The beverage connector may assume three different positions. The first position constitutes a beverage dispensing position in which the pressure chamber is connected to the tapping line and the cleaning unit is disconnected from the tapping line. The beverage dispensing position allows beverage located in the pressure chamber to be transported to the tapping device and be selectively dispensed by operating the handle of the tapping device. In the beverage dispensing position, the cleaning liquid is not allowed to enter the tapping line or tapping device.

The second position constitutes a closed position in which no liquids may pass through the beverage dispensing system.

The third position of the beverage connector constitutes a cleaning position where the cleaning unit is connected to the tapping line and the pressure chamber is disconnected from the tapping line. In the cleaning position, cleaning liquid is transported through the tapping line and may be dispensed by operating the tapping device. In the cleaning position, beverage is not allowed to enter the tapping line or tapping device. The beverage connector is therefore designed to prevent cleaning liquid to mix with the beverage. Thus, when in the cleaning position, the pressure chamber should be sealed from the tapping line and the cleaning unit. Consequently, when in the beverage dispensing position, the cleaning unit should be sealed from the pressure chamber and the tapping line.

The user interface may be controlling both the beverage connector, suitably a discharge valve, and the guiding mechanism such that when the user operates the user interface and initiate cleaning, e.g. by activating a start button for starting the cleaning, thus, when the user interface is in an operator mode, the discharge valve goes into the cleaning position and the drive mechanism starts. The user interface, as part of a maintenance mode, may include a timer for ensuring that the duration of the cleaning is sufficient. The user interface may be automatic, semi-automatic, manual or digital. The user interface may e.g. provide an automatized cleaning and subsequent water flushing, and the duration may even be depending on the usage of the beverage dispensing system and/or based on input from various sensors.

Thus, the cleaning unit can select what it sends to the outlets and thereby control the cleaning process, in particular the pressure fluid in the form of e.g. compressed air to the pressure chambers and the discharge valve going into a cleaning position.

Hence, the cleaning unit may be modified and operated according to the requirements of the user, e.g. operator. A more flexible and efficient operation of the cleaning unit or beverage dispensing system comprising such cleaning unit is thus achieved.

The basic version of the cleaning unit is the core unit of the modular cleaning unit of the beverage dispensing systems. The first inlet of the cleaning unit is adapted for receiving a pressure fluid, preferably compressed air. Pressure fluid is readily available since it is already used for pressurizing the pressure chamber. The pressure fluid is used for propelling the cleaning liquid. Thus, contrary to WO 2016/051204 or US 2006/0175352, which requires a pump to move a liquid detergent around, the present invention uses no pump but instead a pressure fluid propels the cleaning liquid. Furthermore, in the present invention there is no use of gas for purging the tapping lines. Further, there is no use of a gas blender to provide a continuous flow of pressurized gas into the beverage containers.

The second inlet is used for receiving a cleaning liquid, which comprises water and an active cleaning agent such as a detergent, i.e. a mixture of water and active cleaning agent. Various kinds of active cleaning agents may be used depending on the circumstances, i.e. the kind of beverage dispensed and the frequency of performing the cleaning procedure.

The outlet supplies the cleaning liquid to the tapping device via the discharge valve and the tapping line (dispensing line), provided the discharge valve is in the cleaning position and the tapping device is open. The cleaning liquid thereby cleans the tapping device, the discharge valve and the tapping line without thereby contacting the beverage. Optionally, after cleaning the tapping lines, the tapping lines may be "blown out" by compressed air by supplying pressure fluid to the outlet. In this way, any residual cleaning fluid is removed from the tapping line after cleaning and before beverage is allowed to enter the tapping line again.

The guiding mechanism uses the pressure fluid for propelling the cleaning liquid through the cleaning unit with a sufficient pressure for allowing the cleaning liquid to reach the tapping device.

In the present context, the expression "pressure chambers each defining a beverage container or containing a beverage container" should be construed broadly, i.e. not only encompassing a closed chamber in which gas is used as pressure medium, but also chambers using a liquid pressure medium and chambers using solid objects such as pistons directly applying a force onto the collapsible container. Further, it is contemplated that although the present cleaning unit is primarily intended for use together with beverage dispensing systems operating with collapsible containers, it is equally feasible to use together with beverage dispensing systems using non-collapsible containers, such as standard steel containers, or systems using large collapsible bags.

According to a further embodiment of the first aspect, the beverage container is a collapsible beverage container.

According to a further embodiment of the first aspect, the beverage system is absent of Froth on Beer (FOB) detectors.

According to a further embodiment of the first aspect, the cleaning unit comprises a mechanical energy source for being in contact with the cleaning liquid for transferring mechanical stress to said cleaning fluid, the mechanical energy source preferably being a piezo electric device or a piston. The mechanical stress may be induced into the cleaning fluid during cleaning for loosening up any remaining solid residue or film on the tapping lines.

According to a further embodiment of the first aspect, the cleaning unit further comprises an air compressor in fluid communication with the first inlet. An air compressor may be used for supplying compressed air to the first inlet thereby providing the pressure fluid via a pressure line. The air compressor may be integrated into the cleaning unit as a module.

According to a further embodiment of the first aspect, the cleaning unit further comprises a mixing unit in fluid communication with the second inlet, the mixing unit comprising a water inlet for connection to the water mains and active cleaning agent inlet for connection to an active cleaning agent source. In one embodiment, the active cleaning agent is a detergent. The mixing unit may be integrated into the cleaning unit as a module. Using the mixing unit, the detergent may be provided as a concentrate, e.g. in a container, and the mixing module connected to the water main will supply a proper concentration of the detergent as the cleaning liquid to the second inlet.

According to a further embodiment of the first aspect, the mixing unit is capable of selectively providing water only and a mixture of water and active cleaning agent to the second inlet. In this way, the beverage dispensing system may in a first step be rinsed using a concentrated active cleaning agent, and thereafter in a second step, the beverage dispensing system is flushed by pure tap water for removing all traces of the active cleaning agent.

According to a further embodiment of the first aspect, the cleaning unit further comprises a container of pre-mixed cleaning liquid. The pre-mixed cleaning liquid eliminates the need for a mixing unit. Further, it may also eliminate the need for a connection to the water mains. The pre-mixed cleaning liquid may be a weak active cleaning agent, e.g. a weak detergent, which does not require any subsequent flushing, or alternatively, the container may be a double container including both a pre-mixed detergent liquid and pure water for subsequent flushing.

It is also envisaged that the air compressor, suitably provided within a casing, is an air compressor unit, which is provided as a separate unit, i.e. separate module, adjacent the control unit. It is envisaged that the mixing unit is provided as a separate unit, i.e. separate module, adjacent the control unit. In particular, the air compressor unit, mixing unit, and cleaning unit are arranged in a stack, by the cleaning unit resting on the mixing unit, and the mixing unit resting on the air compressor unit being in contact with a surface of the mixing unit casing. Mounting plates on the rear part of the above units can be provided to support and hold the units together. It is also envisaged that the control unit is mounted on a wall, and only the air compressor unit and mixing unit are stacked, by the mixing unit resting on the air compressor unit.

According to a further embodiment of the first aspect, the user interface comprises a maintenance mode and an operator mode. The maintenance mode may include all maintenance and service features such as calibration settings, power settings, timing setting, concentration setting as well as details about the modules which are attached or integrated into the cleaning unit. The operator mode may be simpler, such as allowing only a start button for starting the cleaning.

According to a further embodiment of the first aspect, the user interface is located adjacent the one or more tapping devices, preferably within the immediate manual reach of the user, for instance by the user interface being located at 0.5-1 m from the one or more tapping devices. Thereby, the user may have access directly from the bar counter, on top of which the one or more tapping devices are normally mounted. Further, in this way, the user may perform a cleaning operation without leaving the tapping device. This is particularly useful in case the pressure chamber and cleaning system is located in a separate room, such as in a cellar.

According to a further embodiment of the first aspect, the user interface is a mechanical switch, an electrical switch, a UI display/PCB, optionally including telemetry. These systems constitute alternatives which provide different levels of complexity. The simplest user interface comprises a simple mechanical valve having an on/off setting. This enables that the control unit be used without the need of a power supply. Further complexity is provided by making the valve electrical allowing remote control of the valve and user feedback. A display such as a tablet may be used for providing a GUI allowing further functions and also providing input to the user of e.g. water levels and active cleaning agent levels, and wireless technologies may be used.

According to a further embodiment of the first aspect, the cleaning unit further comprises a gas outlet in fluid communication with the first inlet. In this way, the pressure chamber of the beverage dispensing system may be provided with pressure fluid from the cleaning unit. The cleaning unit controls the provision of air by taking in compressed air and send it forward via one or more pressure lines through the beverage system, thereby increasing safety. In particular, the safety risk of having pressure lines from an air compressor in direct communication with the pressure chambers, is avoided.

In this way, the pressure chamber of the beverage dispensing system may be provided with pressure fluid from the cleaning unit, thus enabling a more efficient and compact construction.

According to a further embodiment of the first aspect, the cleaning unit is mobile. The cleaning unit may e.g. be provided with wheels and quick connectors for easy moving between different establishments, thereby allowing more efficient use of the cleaning unit. This also enables a more user-friendly cleaning unit.

According to a further embodiment of the first aspect, said cleaning liquid comprises activated or energized water, or a weak solution of sodium hypochlorite (NaClO) or hydrogen peroxide ($H_2O_2$), such as between 0.5 ppm and 10% in a watery solution, preferably between 1 ppm and 0.1%, and, optionally, said cleaning unit including a measurement system measuring electrical parameters such as conductivity, capacity or resistance of the cleaning liquid.

Such low percentages of sodium hypochlorite or hydrogen peroxide have been shown to efficiently clean and sterilize the beverage dispensing system while leaving a non-toxic residue. The presence and optionally concentration of the active substance of the detergent may be measured by a measurement system thereby ensuring that the cleaning is properly performed.

Activated or energized water is understood to mean that a voltage/electric field is induced in the tapping line for eliminating bacteria. An example of a similar concept is shown in WO 2009/052827 relating to a sterilization device using electrodes.

According to a second aspect of the present invention, the above mentioned objects and more are achieved by a beverage dispensing system comprising a cleaning unit according to the first aspect. The beverage dispensing system as described above together with the first aspect may be provided together with the cleaning unit described above together with the first aspect.

The beverage dispensing system may comprise one or more sealable pressure chambers, preferably a plurality of sealable pressure chambers, i.e. multiple pressure chambers. A single cleaning unit may preferably be used together with multiple pressure chambers and multiple tapping devices. It may be considered to automatize the cleaning of multiple tapping devices such that they open and close automatically during cleaning, thereby simplifying the operation.

According to a third aspect of the present invention, the above mentioned objects and more are achieved by a method of cleaning a beverage dispensing system by providing a cleaning unit, said beverage dispensing system comprising one or more sealable pressure chambers, each defining a beverage container or containing a beverage container, said one or more pressure chambers being in fluid communication with one or more tapping devices via a beverage connector and a tapping line, said beverage connector having at least a beverage dispensing position, a cleaning position and a closed position, said beverage dispensing position allowing a beverage to be dispensed from said tapping device when said one or more pressure chambers are pressurized while preventing a cleaning liquid from being dispensed from said one or more tapping devices, said cleaning position allowing said cleaning liquid to be dispensed from said one or more tapping devices while preventing said beverage from being dispensed from said one or more tapping devices, and said closed position preventing any of said beverage and cleaning liquid being dispensed from said one or more tapping devices, said method comprising:

- providing a first inlet for receiving a pressure fluid in said cleaning unit,
- providing a second inlet for receiving a cleaning liquid in said cleaning unit, said cleaning liquid comprising water and active cleaning agent,
- providing an outlet in said cleaning unit for supplying said cleaning liquid to said beverage connector of said beverage dispensing system,
- providing a guiding mechanism in said cleaning unit for steering the passage of said cleaning liquid from said second inlet to said outlet, by using said pressure fluid received at said first inlet,
- providing a user interface in said cleaning unit for controlling said guiding mechanism and/or said beverage connector, said method further comprising the steps of:

- causing said beverage connector to assume said cleaning position, and
- supplying said cleaning liquid from said outlet to said one or more tapping devices via said tapping line and said beverage connector.

The method according to the third aspect is preferably used together with any of the previous aspects and embodiments described above.

According to a fourth aspect of the present invention, the above mentioned objects and more are achieved by a cleaning unit for supplying a cleaning liquid to a beverage dispensing system, said beverage dispensing system comprising one or more sealable pressure chambers, each defining a beverage container or containing a beverage container, said one or more pressure chambers being in fluid communication with one or more tapping devices via a beverage connector and a tapping line, said beverage connector allowing a beverage to be dispensed from said one or more tapping devices when said one or more pressure chambers are pressurized, said cleaning unit comprising:

a first inlet for receiving a pressure fluid, a second inlet for receiving water or a cleaning liquid, said cleaning liquid comprising water and an active cleaning agent, an outlet for supplying said cleaning liquid to said beverage connector of said beverage dispensing system and an outlet for supplying said pressure fluid, a guiding mechanism for steering the passage of said cleaning liquid from said second inlet to said outlet, using said pressure fluid received at said first inlet, and a user interface for controlling said guiding mechanism and/or said beverage connector, and wherein said beverage connector is a discharge valve, said discharge valve having at least a beverage dispensing position, a cleaning position and a closed position, said beverage dispensing position allowing a beverage to be dispensed from said tapping device when said one or more pressure chambers are pressurized while preventing a cleaning liquid from being dispensed from said one or more tapping devices, said cleaning position allowing said cleaning liquid to be dispensed from said one or more tapping devices while preventing said beverage from being dispensed from said one or more tapping devices, and said closed position preventing any of said beverage and cleaning liquid being dispensed from said one or more tapping devices.

Hence, the second inlet may receive not only a cleaning liquid, which comprises water and an active cleaning agent, but also water only, e.g. from water mains.

In a particular embodiment, the control unit comprises a third inlet for receiving water, e.g. from water mains. It would be understood that this third inlet is a separate inlet for receiving water.

According to a fifth aspect of the present invention, the above mentioned objects and more are achieved by a beverage dispensing system comprising a cleaning unit according to the fourth aspect.

Any of the embodiments of the first, second and third aspect may be used together with the fourth and fifth aspect of the invention.

DETAILED DESCRIPTION OF THE DRAWINGS

Figure 1:
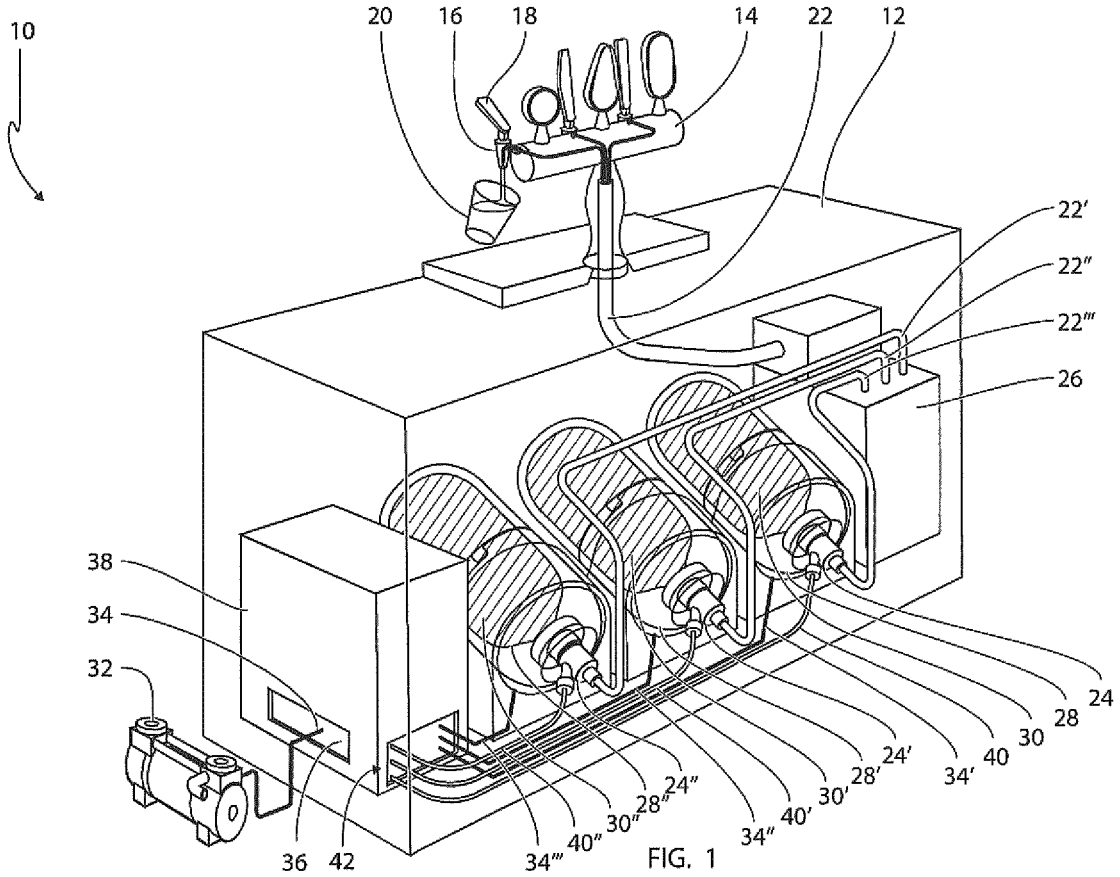
FIG. 1 is a perspective view of a beverage dispensing system according to the present invention.

FIG. 1 shows a perspective view of a beverage dispensing system 10. The beverage dispensing system 10 comprises a bar counter 12 onto which a tapping rod 14 is mounted. The tapping rod 14 comprises at least one, and in the present embodiment three, tapping devices 16. The tapping devices 16 each has a handle 18. By swinging the handle 18 from its normal horizontal position to a vertical position, a valve within the tapping device 16 is opened, and beverage is allowed to pass from the tapping device 16 to a beverage glass 20 located below the tapping device. Alternatively, a cleaning liquid, provided cleaning is initiated, is allowed to pass through the tapping device 16. It is evident that electronic valves may be used as well allowing the tapping device 16 to be operated by a push button (not shown).

The tapping device 16 is connected to a tapping line 22 which in the present embodiment leads below the bar counter 12 but which alternatively may lead to a central storage room such as a cellar. The tapping line 22 is led to a beverage connector, such as in the present case a discharge valve 24, optionally via a pass through cooling unit 26. In the present embodiment, the tapping line 22 is split up into three lines 22' 22" 22'", each leading to a separate discharge valve 24 24' 24". It is of course contemplated that different configurations of parallel- and series connected tapping lines may be used.

Each discharge valve 24 24' 24" is coupled to a separate pressure chamber 28 28' 28", each of which in turn may accommodate a collapsible beverage container 30 30' 30". The beverage container 30 30' 30" is preferably made of plastic or similar polymeric and flexible material and includes a preferably carbonated beverage. A pressure line 34 leads from a compressor 32 to a first inlet 36 of a cleaning unit 38 for providing pressurized air to the cleaning unit 38. Each pressure chamber 28 28' 28" is connected to the compressor 32 via the cleaning unit 38. Pressure lines 34 34" 34'" extend from the cleaning unit 38 for pressurization of the pressure chambers 28 28' 28". For safety reasons, in order to allow a better control of the pressure supplied to the pressure chambers, no pressure lines extend directly between the compressor 32 and the pressure chambers 28 28' 28" although such solution would in principle be feasible. Each pressure chamber 28 28' 28" is thereby pressurized using air pressure sufficient for collapsing the beverage container 30 30' 30" located in the pressure chamber 28 28' 28", and propelling the beverage from the beverage container 30 30' 30" through the discharge valve 24 24' 24" and tapping line 22 22' 22" 22'" and out through the tapping device 16.

Further, at least one, and in the present embodiment three, cleaning lines 40 40' 40" extend between an outlet 42 of the cleaning unit 38 to the discharge valves 24 24' 24" for providing cleaning liquid to the discharge valves 24 24' 24", tapping lines 22 22' 22" 22'" and tapping device 16. The discharge valves 24 24' 24" have a beverage dispensing position, a cleaning position and a closed position. The beverage dispensing position allows the beverage to be dispensed from the tapping device when the pressure chamber is pressurized while preventing the cleaning liquid from being dispensed from the tapping device. The rinsing i.e. cleaning position allows the cleaning liquid to be dispensed from the tapping device while preventing the beverage from being dispensed from the tapping device. The closed position prevents any of the beverage and cleaning liquid being dispensed from the tapping device.

Figure 2:
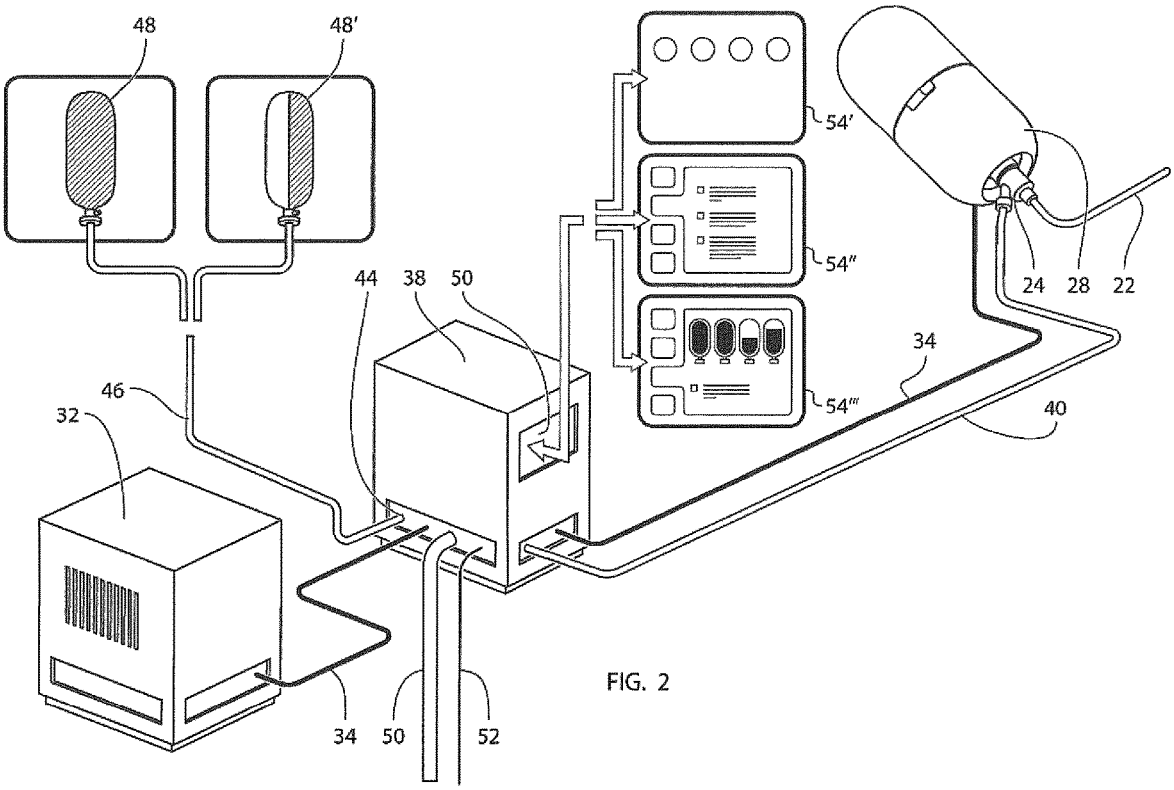
FIG. 2 is a schematic view of the beverage dispensing system and cleaning unit.

FIG. 2 is a schematic view of the beverage dispensing system and cleaning unit. The cleaning unit 38 comprises a second inlet 44 for connecting a cleaning line 46, through which an active cleaning agent such as detergent passes, to a container including active cleaning agent 48. The active cleaning agent 48 is mixed with water 50 from the water mains to form the cleaning liquid. In one embodiment, a pre-mixed cleaning liquid 48' may be used, eliminating the need for a connection to the water mains. After the cleaning liquid has passed through the tapping device, the lines are flushed using water, which may be provided from the water mains, from a separate water container or from a multi-chambered container which includes both water and detergent. In a particular embodiment, a non-toxic and essentially tasteless cleaning liquid is used, such as a weak solution of sodium hypochlorite (NaClO), thereby eliminating the need for flushing with water.

Further, the cleaning unit 38 includes a user interface 54. The user interface may be a simple set of buttons 54' for manual control of the cleaning, to a graphical GUI 54" allowing automatic control. The user interface may even provide information to the user about the content 54''' of beverage in the containers. The user interface may preferably be located adjacent said one or more tapping devices so that the user has direct access from the bar counter. The cleaning unit 38 and the compressor 32 is preferably connectable to the electricity mains 52 for providing power.

REFERENCE NUMERALS

10. Beverage dispensing system
12. Bar counter
14. Tapping rod
16. Tapping device
18. Handle
20. Beverage glass
22. Tapping line
24. Discharge valve
26. Cooling unit
28. Pressure chamber
30. Beverage container
32. Compressor
34. Pressure line
36. First inlet
38. Cleaning unit
40. Cleaning line
42. Outlet
44. Second inlet
46. Detergent line
48. Active cleaning agent
50. Water
52. Electricity mains
54. User interface

The invention claimed is:

1. A beverage dispensing system comprising a cleaning unit for supplying a cleaning liquid to the beverage dispensing system, said beverage dispensing system comprising one or more sealable pressure chambers, each pressure chamber defining a beverage container or containing a beverage container, said one or more pressure chambers being in fluid communication with one or more tapping devices via a beverage connector and a tapping line, said beverage connector allowing a beverage to be dispensed from said one or more tapping devices when said one or more pressure chambers are pressurized, the one or more tapping devices comprising a tapping valve and a tapping handle for operating the tapping valve, said cleaning unit comprising:

a first inlet for receiving a pressure fluid, a second inlet for receiving a cleaning liquid, said cleaning liquid comprising water and an active cleaning agent, an outlet for supplying said cleaning liquid to said beverage connector of said beverage dispensing system, said cleaning liquid being steered from said second inlet to said outlet using said pressure fluid received at said first inlet for propelling the cleaning liquid, and a user interface for controlling said supplying of said cleaning liquid to said beverage dispensing system, and wherein said beverage connector is a three-port discharge valve, said discharge valve having at least a beverage dispensing position, a cleaning position and a closed position, said beverage dispensing position allowing a beverage to be dispensed from said tapping device when said one or more pressure chambers are pressurized while preventing a cleaning liquid from being dispensed from said one or more tapping devices, said cleaning position allowing said cleaning liquid to be dispensed from said one or more tapping devices while preventing said beverage from being dispensed from said one or more tapping devices, and said closed position preventing any of said beverage and cleaning liquid from being dispensed from said one or more tapping devices; and wherein said cleaning unit comprises a mechanical energy source for being in contact with said cleaning liquid for transferring mechanical stress to said cleaning liquid.

2. The beverage dispensing system according to claim 1, wherein said mechanical energy source is a piezo electric device.

3. The beverage dispensing system according to claim 1, wherein said cleaning unit further comprises an air compressor in fluid communication with said first inlet.

4. The beverage dispensing system according to claim 1, wherein said cleaning unit further comprises a mixing unit in fluid communication with said second inlet, said mixing unit comprising a water inlet for connection to a water mains and said mixing unit comprising active cleaning agent inlet for connection to an active cleaning agent source.

5. The beverage dispensing system according to claim 4, wherein said mixing unit is capable of selectively providing water only separate from selectively providing a mixture of water and active cleaning agent to said second inlet.

6. The beverage dispensing system according to claim 1, wherein said cleaning unit further comprises a container of cleaning liquid comprising active cleaning agent mixed with water.

7. The beverage dispensing system according to claim 1, wherein said user interface is located adjacent said one or more tapping devices.

8. The beverage dispensing system according to claim 1, wherein said user interface (UI) is a mechanical switch, an electrical switch, or a UI display/printed circuit board (PCB).

9. The beverage dispensing system according to claim 1, wherein said cleaning unit further comprises a gas outlet in fluid communication with said first inlet.

10. The beverage dispensing system according to claim 9, wherein the gas outlet is in fluid communication with the one or more pressure chambers for pressurization of the one of more pressure chambers.

11. The beverage dispensing system according to claim 1, wherein said cleaning unit is provided with wheels and quick connectors.

12. The beverage dispensing system according to claim 1, wherein said cleaning liquid comprises a solution of sodium hypochlorite (NaClO) or hydrogen peroxide ($H_2O_2$).

13. The beverage dispensing system according to claim 12, wherein the solution of sodium hypochlorite (NaClO) or hydrogen peroxide ($H_2O_2$) is between 0.5 ppm and 10% in a watery solution, or between 1 ppm and 0.1% in a watery solution.

14. The beverage dispensing system according to claim 12, wherein said cleaning unit includes a measurement system measuring electrical parameters.

15. The beverage dispensing system according to claim 14, wherein the electrical parameters are one or more of conductivity, capacity, or resistance of the cleaning liquid.

16. The beverage dispensing system according to claim 1, wherein the outlet is in fluid communication with the tapping line for supplying pressure fluid for blowing out the tapping line.

* * * * *